United States Patent [19]

Nichols, Philip T.

[11] Patent Number: 4,709,718

[45] Date of Patent: Dec. 1, 1987

[54] TENT FLY APPARATUS AND METHOD

[76] Inventor: Nichols, Philip T., 4399 Walter Way, West Valley City, Utah 84120

[21] Appl. No.: 861,062

[22] Filed: May 8, 1986

Related U.S. Application Data

[63] Continuation-in-part of Ser. No. 732,494, May 9, 1985, abandoned.

[51] Int. Cl.[4] ..... A45F 1/16; E04B 1/347

[52] U.S. Cl. ..... 135/106; 135/97; 135/104; 135/115; 135/905

[58] Field of Search ..... 135/97, 98, 104, 106, 135/115, 905

[56] References Cited

U.S. PATENT DOCUMENTS

| | | | |
|---|---|---|---|
| 3,417,764 | 12/1968 | Hemenway | 135/107 |
| 3,598,133 | 8/1971 | Abert | 135/115 X |
| 3,621,857 | 11/1971 | May et al. | 135/102 X |
| 3,670,747 | 6/1972 | Pohl et al. | 135/105 X |
| 3,834,410 | 9/1974 | Leibel | 135/105 X |
| 3,951,159 | 4/1976 | Robinson et al. | 135/905 X |
| 4,078,572 | 3/1978 | Moss | 135/97 |
| 4,102,352 | 7/1978 | Kirkham | 135/97 |
| 4,165,757 | 8/1979 | Marks | 135/104 X |
| 4,236,543 | 12/1980 | Moss | 135/106 X |
| 4,269,210 | 5/1981 | Marks | 135/104 |
| 4,285,355 | 8/1981 | Lundblade | 135/109 X |
| 4,352,362 | 10/1982 | Nichols | 135/98 |
| 4,506,688 | 3/1985 | Bethoon et al. | 135/107 |

*Primary Examiner*—J. Karl Bell

*Attorney, Agent, or Firm*—J. Winslow Young

[57] ABSTRACT

This invention relates to a novel rain fly for a tent wherein the rain fly is readily mountable/demountable to the tent through a unique spar system and lanyard system. The spar is flexible and can be formed from segments so as to reduce the overall size of the tent rain fly when the rain fly is in its folded configuration. The length of the spar is sufficient to provide a unique gable/eave over the door/window of the tent.

11 Claims, 7 Drawing Figures

TENT FLY APPARATUS AND METHOD

BACKGROUND

1. Field of the Invention

This invention relates to tents and, more particularly, to a tent fly apparatus and method having a demountable fly for a tent to protect the tent from the elements.

2. Related Applications

This application is a continuation-in-part application of my copending application for U.S. Letters Patent Ser. No. 06/732,494 filed May 9, 1985 now abandoned for Tent Fly Apparatus and Method and is filed to more clearly set forth my novel invention for a tent fly.

3. The Prior Art

Tents are popular as portable, temporary shelters and are widely used in numerous recreational pursuits. A tent consists of a fabric shelter portion or shell and a supporting framework for the shell. Various configurations of tent shells and frameworks are available and well known in the art. In order to provide shelter against precipitation, it is customary to manufacture the tent shell from a water repellent or water-resistant material. The alternative is to manufacture the fabric tent shell from a canvas-type material which provides marginal protection from precipitation. Newer, synthetic materials such as nylon are currently popular because of their lightweight, ease of erection and colorful appearance.

Each of these tent fabrics has a shortcoming resulting from the fabric of construction. For example, waterproof or water-repellent materials tend to cause condensation to collect on the inner surface during periods of cold weather much to the annoyance and discomfort of the occupants. On the other hand, tent fabrics that "breathe" are limited in their ability to shed water. Furthermore, tents exposed to the direct sunlight tend to become stuffy and hot.

In view of the foregoing, it would be an advancement in the art to provide an improved tent fly apparatus and method that is convenient to use, easily mountable and demountable and, also, can be used to shield a tent from the elements while imparting a limited amount of insulating effect to the tent. Such a novel tent apparatus and method is disclosed and claimed herein.

BRIEF SUMMARY AND OBJECTS OF THE INVENTION

The present invention relates to a novel tent fly apparatus and method for a tent wherein the tent fly is fabricated from a suitable material and is joined to a spar to form the tent fly. The tent fly is easily mountable and demountable on a tent. The spar is an automatic or self-erecting spar fabricated in sections which can be disjoined to reduce the overall length of the spar to permit the fly to be folded into a fairly compact configuration. The fly provides a gable on opposite sides of the tent and permits reasonable air flow over the tent shell for reducing condensation while shielding the tent shell from the direct sun and rain.

It is, therefore, a primary object of this invention to provide a rain fly apparatus for a tent.

Another object of this invention is to provide a unitary rain fly preassamelbed from a fabric and a supportive spar joined into the single unit.

Another object of this invention is to provide a method for providing a rain fly for a tent.

Another object of this invention is to provide a rain fly that is easily removable and foldable.

Another object of this invention is to provide a rain fly that is releasably secured to a tent and provides a gable at opposite sides of the tent.

These and other objects and features of the present invention will become more fully apparent from the following description and appended claims taken in conjunction with the accompanying drawing.

DETAILED DESCRIPTION OF THE INVENTION

Figure 1:
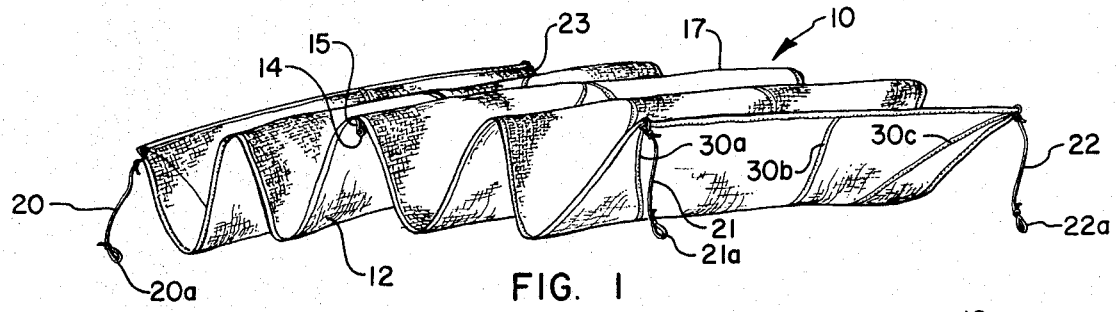
FIG. 1 is a perspective view of the rain fly of this invention shown in the partially unfurled position.
Figure 2:
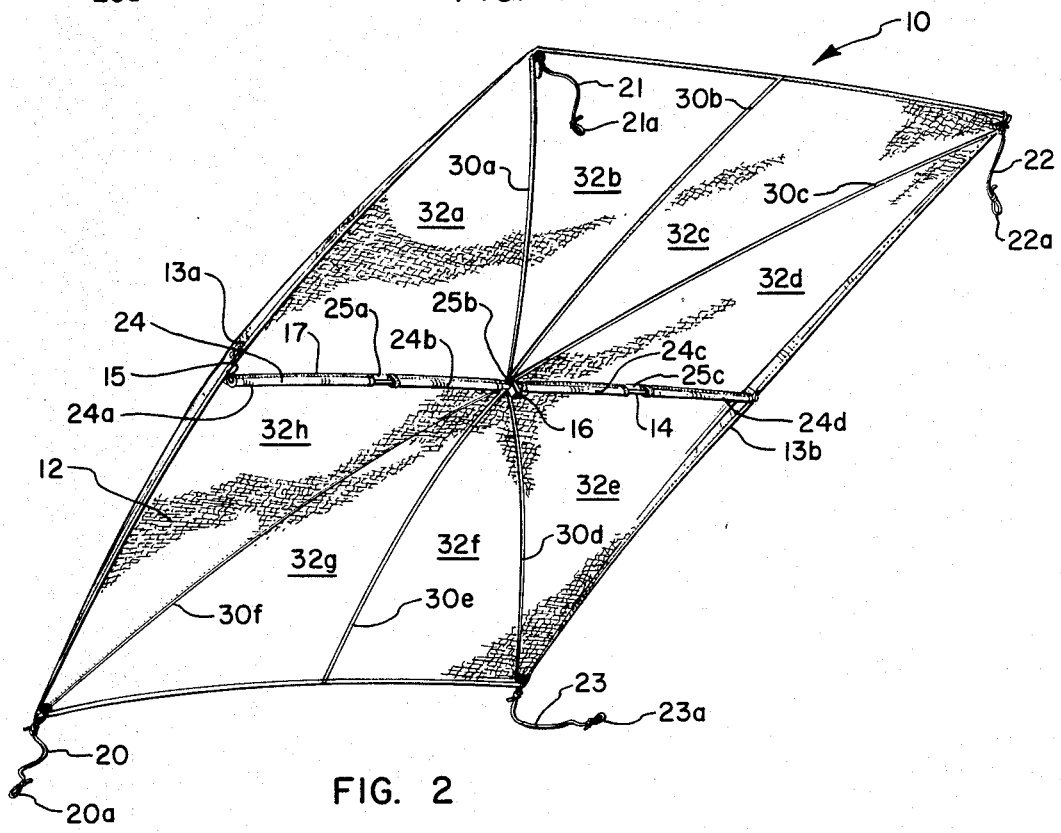
FIG. 2 is a perspective view of the underside of the rain fly of FIG. 1 shown in the fully extended configuration.

The invention is best understood by reference to the drawing wherein like parts are referred to with like numerals throughout.

Figure 3:
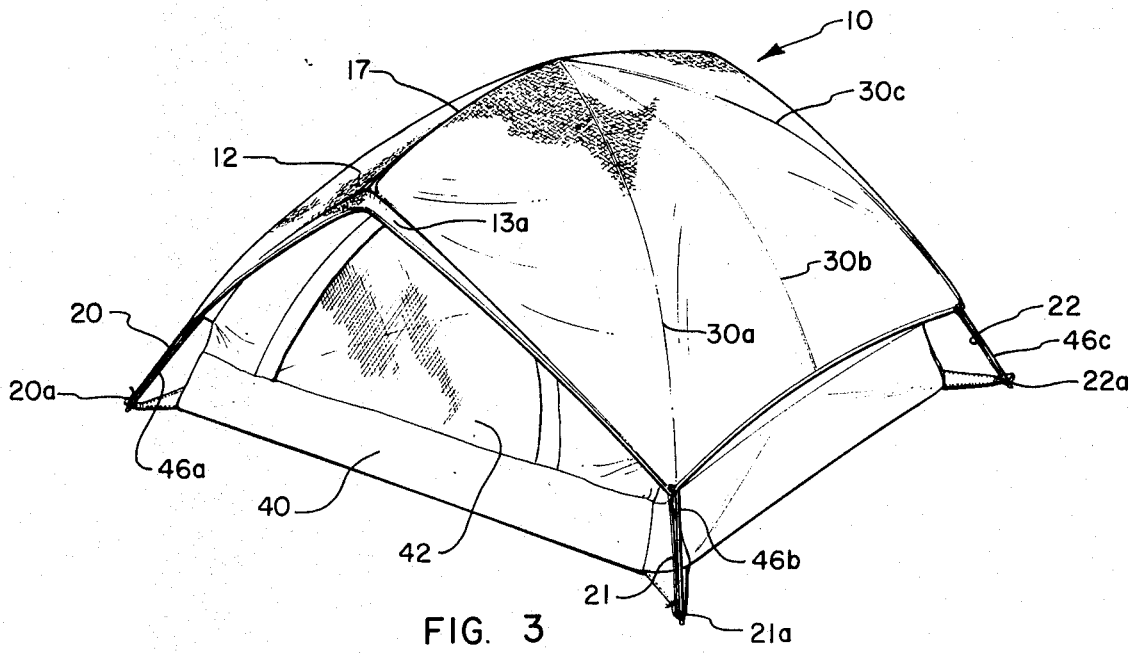
FIG. 3 is a perspective view of the rain fly of FIGS. 1 and 2 secured over a tent.

Referring now to the drawing, the novel rain fly of this invention is shown generally at 10 and includes a fabric sheet 12 having a spar 14 mounted thereto in a sleeve 24 and secured by elastic cord 15. Fabric sheet 12 may be fabricated from any suitable, flexible, sheet material such as plastic, nylon fabric, or the like. Preferably, fabric sheet 12 is prepared so as to repel water to thereby provide protection against precipitation for tent 40 (FIG. 3). Fabric sheet 12 may be either a unitary sheet of material or may be fabricated from sections of fabric joined along seams 17 and **30*a*–30*f*. This latter technique allows the manufacturer to prepare rain fly 10 as a colorful rain fly by selectively fabricating each of panels 32*a*–32*h*** from a plurality of colors to the delight of the purchaser.

Spar 14 is configured from a plurality of tubular, hollow segments **14*a* and 14*b* (FIGS. 4–7) joined in a hollow socket 53 and having an elastic cord 52 passing through the hollow tubular segments. An end of the elastic cord is shown at 15 and loosely secures the edge of sheet 12 to spar 14 in one embodiment, other embodiments being more clearly described at FIGS. 4–7. The loose securement by elastic cord provides sufficient slack to permit the tubular hollow segments 14*a* and 14*b* of spar 14 to be separated (FIGS. 5 and 7). Sleeve 24 is formed from sleeve sections 24*a*–24*d* with sleeve openings 25*a*–25*c* therein to permit the user to disconnect spar 14 as is conventional. The center of spar 14 at sleeve opening 25*b* includes a peg member 16 to assist in mounting rain fly 10 to tent 40. In this instance, tent 40** is configured similarly to the tent shown in my U.S. Pat. No. 4,352,362, issued Oct. 5, 1982. In particular, rain fly 10 is mounted to tent 40 by inserting peg member 16 downwardly into apex ring 70 (shown at FIG. 4 therein).

Lanyards 20–23 are secured to each corner of sheet 12 and include loops 20a–23a therein for the securement of rain fly 10 to tent 40 as shown at FIG. 3. In particular, peg member 16 is inserted downwardly into the apex ring (not shown) in the upper framework of tent 40. Each of lanyards 20–23 is secured to the foot of the respective tent poles 46a–46c by having loops 20a–23a slipped over the ends thereof. The length of lanyards 20–23 are selectively predetermined in combination with the dimensions of sheet 12 and the overall dimensions of tent 40 so that securement of lanyards 20–23 to the respective tent poles 46a–46c of tent 40 will pull the sides of rain fly 10 downwardly into a snug fitting relationship with tent 40. Spar 14 is configured with sufficient flexibility to allow a limited degree of bending to create a spring tension to rain fly 10 as shown by the curvilinear configuration of the ridge formed along seam 17 in FIG. 3.

A novel gable or eave effect for rain fly 10 is created by selectively predetermining the length of spar 14 and the width of sheet 12 in combination with the overall dimensions of tent 40 so that rain fly 10 extends beyond the sidewalls and, more particularly, door/window 42 of tent 40, with a narrow segment 13a folding downwardly over the end of spar 14 to conceal sleeve 24 and sleeve openings 25a–25c as well as the end of spar 14 and elastic cord 15 while providing an aesthetically pleasing eave or gable to rain fly 10. This technique also allows the respective lanyards 20–23 to tightly stretch fabric sheet 12 over spar 14 to remove any unsightly folds of wrinkles in fabric sheet 12.

Figure 4:
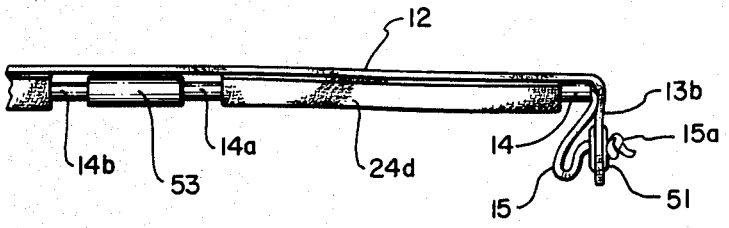
FIG. 4 is an enlarged, partial cross-sectional view of a fragmentary portion of the rain fly showing one preferred embodiment for securement of the edge of the rain fly fabric to the spar.
Figure 5:
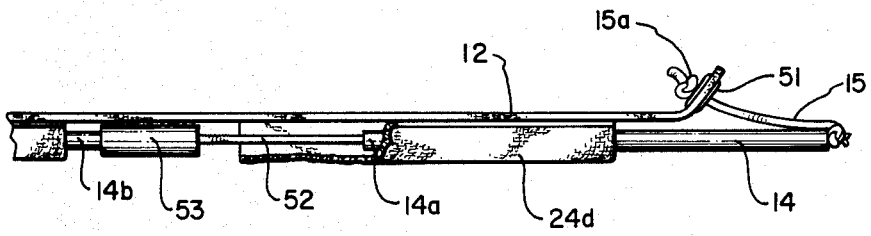
FIG. 5 is the view of FIG. 4 with the spar extended to illustrate the relationship between the spar and the fabric of the rain fly.

Referring now more particularly to FIGS. 4 and 5, lanyard 15 secures the edge of fabric sheet 12 to the end of spar 14 by a knot 15a in the end of lanyard 15, lanyard 15 having been passed through a grommet 51 in the edge of fabric sheet 12. Lanyard 15 is inelastic but has sufficient slack (shown at FIG. 4) between spar 14 and grommet 51 in fabric sheet 12 so that spar segment 14a can be extended beyond the edge of fabric sheet 12 to permit spar segment 14a to be released from socket 53 against the tension of elastic cord 52 (FIG. 5).

Figure 6:
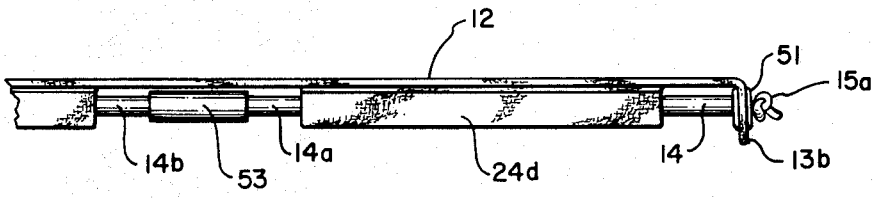
FIG. 6 is an enlarged, partial cross-sectional view of a fragmentary portion of the rain fly showing another preferred embodiment for securement of the edge of the rain fly fabric to the spar.
Figure 7:
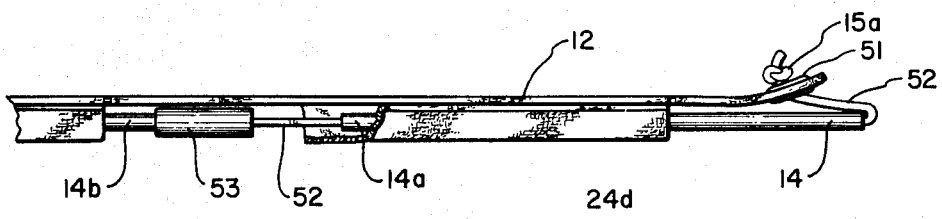
FIG. 7 is the view of FIG. 6 with the spar extended to illustrate the relationship between the spar and the fabric of the rain fly.

Another embodiment of the interrelationship between fabric sheet 12 and spar 14 is shown at FIGS. 6 and 7 wherein the end of elastic cord 52 is attached directly to the edge of fabric sheet 12 by means of grommet 51 and knot 15a. In this instance, the downward fold in fabric sheet 12 or overhang 13b is foreshortened incrementally over that shown in FIG. 4 although this foreshortening will be a matter of the aesthetic appearance of rain fly 10. Release of spar segment 14a from socket 53 is accomplished by pulling spar segment 14a longitudinally stretching elastic cord 52 as shown at FIG. 7 so as to accommodate the necessary separation for subsequent folding of spar 14 and fabric sheet 12.

The Method

Rain fly 10 is fabricated as described hereinbefore from a sheet 12 with a sleeve 24 formed along centerline seam 17. Spar 14 is inserted in sleeve 24 and secured to sheet 12 by the end of elastic cord 15 and/or alternatively, as shown and described at FIGS. 4–7. Lanyards 20–23 are then mounted to the respective corners of sheet 12.

Rain fly 10 is mounted to tent 40 after tent 40 has been erected. Mounting is accomplished by extending spar 14 to its full, erect length and then inserting center peg 16 downwardly into the apex ring (not shown) of tent 40 as described. Spar 14 is aligned over door/window 42 and lanyards 20–23 are then secured to the respective tent poles 46a–46c.

Removal of rain fly 10 from tent 40 is accomplished by releasing lanyards 20–23 and lifting center peg 16 off tent 40. Sheet 12 is then folded along seam 17 to expose sleeve 24, and more particularly, openings 25a–25c therein. Spar 14 is collapsed into its respective spar segments by release of the respective joints by access thereto through openings 25a–25c as is conventional and as described at FIGS. 4–7. Sheet 12 is folded to correspond with the respective segments of spar 14. Thereafter, sheet 12 is rolled around the spar segments of spar 14 to create a relatively compact bundle for rain fly 10.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A mountable and demountable rain fly system for a tent comprising:

a single spar, said spar being formed from a plurality of hollow sections releasably mountable end-to-end into joints to form said spar and including an elastic means passing through said hollow sections to releasably hold said hollow sections in said end-to-end relationship to form said spar;

mounting means on said spar for removably mounting said spar to said tent;

a rain fly comprising a fabric sheet mounted to said spar to form said rain fly as a single unit, said fabric sheet being mounted over said spar and having a plurality of spar-receiving sleeves, said sleeves having a plurality of openings, said openings corresponding to said joints in said spar to permit separation of said hollow sections;

slack means in said rain fly to accommodate separation of said joints; and securement means for releasably securing said rain fly system to said tent when said mounting means is mounted to said tent.

2. The rain fly system defined in claim 1 wherein said spar comprises a ridge pole to form a gable in said rain fly on opposite sides of said tent.

3. The rain fly system defined in claim 1 wherein said slack means comprises said fabric of said rain fly extending an incremental distance beyond each end of said spar, said incremental distance providing said slack in said rain fly to accommodate separation of said hollow sections at said joints.

4. The rain fly system defined in claim 1 wherein said slack means comprises a lanyard connecting an end of said spar to said fabric.

5. The rain fly system defined in claim 1 wherein said slack means comprises an elastic lanyard connecting an end of said spar to said fabric.

6. The rain fly system defined in claim 1 wherein said securement means comprises an elastic cord means attached to each corner of said fabric and releasably mountable to said tent thereby holding said rain fly downwardly over said tent with said spar forming a ridge pole over which ridge pole said rain fly is pulled downwardly by said elastic cord means.

7. A rain fly system for a tent comprising:

a single spar comprising a plurality of hollow sections separably joined end-to-end in joints with an elastic shock cord passing through said hollow sections and resiliently holding said hollow sections together at said joints;

mounting means adjacent the center of said spar for releasably mounting said spar to said tent;

a rain fly comprising a water resistant fabric and having engagement means for engaging said rain fly to said spar as a single unit with said fabric being mounted over said spar, said engagement means comprising a spar-receiving sleeve having a plurality of openings, said openings corresponding to said joints, slack means for providing slack between said fabric and said spar to permit separation of said hollow sections; and attachment means for releasably attaching the periphery of said rain fly to said tent.

8. The rain fly system defined in claim 7 wherein the rain fly further comprises an elastic cord means between an end of said spar and said fabric to provide said slack means.

9. The rain fly system defined in claim 7 wherein said attachment means comprises a plurality of elastic cords mounted to corners of said fabric and adapted to releasably attach to said tent, thereby stretching said fabric downwardly over said tent.

10. A method for providing a rain fly for a tent, the tent including a support framework and a fabric tent shell supported by said support framework comprising:

preparing a single spar for removably mounting to said support framework, said spar comprising a plurality of hollow sections joined end-to-end in joints and being releasably held in said joints by an elastic cord means passing through said hollow sections;

obtaining a rain fly comprising a water resistant fabric and forming a plurality of sleeve segments along a midline of said rain fly;

inserting said spar into said sleeve segments with said sleeve segments corresponding to said hollow sections with said fabric being mounted over said spar;

attaching said rain fly to said spar by securing a mounting means comprising slack means for providing slack between said rain fly and said spar to permit separation of said hollow sections of said spar; and mounting said rain fly to said tent and securing the periphery of said rain fly to said support framework adjacent a lower portion of said support framework.

11. The method defined in claim 10 wherein said attaching step comprises connecting said spar to said rain fly with an elastic cord attached between said spar and said rain fly.

* * * * *